US007611087B2

(12) United States Patent
Gatti

(10) Patent No.: US 7,611,087 B2
(45) Date of Patent: Nov. 3, 2009

(54) METHOD AND APPARATUS FOR WINDING UP CORELESS AND SOFT-CORE ROLLS OF FILM MATERIALS

(75) Inventor: Roberto Pellengo Gatti, Novara (IT)

(73) Assignee: No.El. S.r.l., San Pietro Mosezzo, Novara (IT)

( * ) Notice: Subject to any disclaimer, the term of this patent is extended or adjusted under 35 U.S.C. 154(b) by 392 days.

(21) Appl. No.: 11/629,177

(22) PCT Filed: May 18, 2005

(86) PCT No.: PCT/EP2005/005368

§ 371 (c)(1),
(2), (4) Date: Dec. 11, 2006

(87) PCT Pub. No.: WO2005/123555

PCT Pub. Date: Dec. 29, 2005

(65) Prior Publication Data

US 2008/0315027 A1 Dec. 25, 2008

(30) Foreign Application Priority Data

Jun. 17, 2004 (IT) ..... MI2004A1223

(51) Int. Cl.
*B65H 23/18* (2006.01)

(52) U.S. Cl. ..... 242/412.2; 242/413.3; 242/417.1; 242/419.3; 242/532.2

(58) Field of Classification Search ..... 242/412, 242/412.2, 413.3, 417.1, 419.3, 532.2
See application file for complete search history.

(56) References Cited

U.S. PATENT DOCUMENTS

| | | | | |
|---|---|---|---|---|
| 4,070,951 | A | 1/1978 | Bala et al. | |
| 4,277,032 | A * | 7/1981 | Alberto et al. | 242/523.1 |
| 5,003,752 | A | 4/1991 | Matsumoto | |
| 5,062,582 | A * | 11/1991 | Harmon et al. | 242/412.2 |
| 5,228,635 | A * | 7/1993 | Tanaka et al. | 242/413.3 |
| 5,611,272 | A * | 3/1997 | Steuer | 101/23 |
| 6,230,616 | B1 * | 5/2001 | Steuer | 101/23 |

FOREIGN PATENT DOCUMENTS

| | | |
|---|---|---|
| EP | 0 728 102 | 8/1996 |
| JP | 05 086216 | 4/1993 |

* cited by examiner

*Primary Examiner*—Sang Kim
(74) *Attorney, Agent, or Firm*—Young & Thompson

(57) ABSTRACT

A method and an apparatus f or winding careless and soft-core rolls (11), of film materials (10). The film (10) is made to advance, at differentiate speeds (S1, S2), between a first and a second drawing unit (12, 21) making the film (10) to perform a floating loop (19). The film (10) is fed in a controlled way, making it adhere to a grooved corrugating drum (22) by an air jet (29) to corrugate cross corrugations in the film (10) while it is being wound up; the corrugations of the film (10) traps air and prevents the implosion of the roll (11). A programmable electronic unit (32), controls the drawing units (12, 21) in relation to control signals (E1, E2) related to the feeding and winding up speeds (S1, S2) of the film (10), and in relation to a control signal supplied by a sensing device (28) for detecting the position of the floating loop (19).

27 Claims, 5 Drawing Sheets

METHOD AND APPARATUS FOR WINDING UP CORELESS AND SOFT-CORE ROLLS OF FILM MATERIALS

BACKGROUND OF THE INVENTION

This invention refers to the production of soft-core and coreless rolls of films or continuous band of thin sheet material such as stretchable and heat shrinkable plastic films, or bands in paper or different materials, which are continuously fed, embossed and wound or rolled up onto a spindle to form a roll in a controlled mode.

More precisely, the invention relates to a method and an apparatus for producing soft-core and coreless rolls of a film material namely devoid of a support tube, or provided with a support soft tubular core for winding up the film. For the purpose of the present invention, "soft-core" means a core of soft or flexible material, such as paper and the like, for winding up the film, compared to rigid cardboard cores.

The invention is also directed to a coreless or soft-core roll of film material obtained according to the claimed method.

Although the formation of coreless or soft-core rolls for example of plastic film, currently has a specific use in the packaging or for winding palletised loads with a pre-stretched film, this invention is nevertheless applicable to the formation of coreless rolls or provided with a soft tubular core, by any type of extensible or heat-shrinkable plastic films, paper or different sheet material depending upon the circumstance and use.

It is well known that heat-shrinkable or extensible plastic films wound into roll, are normally used for rolling up and packaging palletised loads or goods.

The use of extensible and heat-shrinkable plastic films is widespread in the packaging field, in that it offers the possibility of adequately consolidating any type of palletised load or packaged goods, by simply winding around and making the film adhere to the load or good with a certain tension.

Furthermore, the use of pre-stretched plastic films proves to be advantageous in that pre-stretching gives the plastic material greater resistance, and in that a pre-stretched film can be wound around a load, especially delicate loads or goods, without causing excessive stress.

However, in winding up rolls of film, and in their subsequent use, several problems arise which have been variously tackled and variously solved in the past.

In fact, with usual smooth films, it is difficult to wind coreless rolls or to wind up the film on a soft tubular core, which has a stable shape, due to their tendency to implode.

Moreover, pre-stretched films or elastically yielding films retain an elastic memory which over time makes them to shrink in such a way that the outer turns generate a pressure on the inner turns, deforming and making them adhere to one another, thereby preventing or making it difficult to properly unwind the stretched film from a roll.

This problem has been partially solved by suitably embossing the film, for example by forming a plurality of small pockets, by slightly deforming the film against an appropriate toothed embossing drum, trapping the air and preventing a close contact between the turns of the roll.

An apparatus for embossing extensible film wound up into a roll is described for example in EP-A-0 728 102.

According to this document, the plastic film is made to move, at a constant speed, between a set of drawing rollers connected to a control motor; a toothed drum embosses the film, before it being wound onto a roll, maintaining the plastic film under a stretched condition so as to make it frictionally adhere to the toothed surface of the embossing drum; the teeth of the embossing drum cause a partial deformation of the plastic film and the consequent formation of small pockets in which air remains trapped during a subsequent winding step of the roll.

This solution has however a number of drawbacks, such as for example the difficulty in obtaining evenly wound rolls having a constant diameter; in fact the deformation of the film, necessary to form the small embossed pockets for entrapping the air, tends to generate irregularly distributed internal stresses, with the consequent formation of creases in the film during the winding up of the roll. Moreover, since the air remains entrapped in the individual pockets, without any possibility of venting, the rolls of film have a final diameter, which is still considered to be excessive, in relation to the quantity of wound up film.

Lastly, the winding up of coreless as soft-core rolls by the methods and apparatuses currently in use, leads to the formation of rolls having very large diameters, with consequent higher storage and transport costs due to the larger volume incurred by the same rolls.

U.S. Pat. No. 5,003,752 describes a winding up method and an apparatus for rolling up a pre-stretched film around a load, which make use of stretching rolls each having alternate and intermeshing peripheral ridges, arranged such that the ridges on each roll mesh with the grooves on the other roll; the plastic film introduced between the stretching rolls, is continuously folded in the longitudinal direction and forcibly drawn, stretched longitudinally and in the crosswise direction; the stretched film emerging from the stretching rolls to be wound around the load, is again in a smooth or flat form.

OBJECTS OF THE INVENTION

The main object of this invention is to provide a method and an apparatus for winding up coreless and soft-core rolls of film materials, whereby it is possible to adequately obviate the aforementioned problems, improving both the winding and the unwinding of the same film from a roll.

In particular, an object of the invention is to provide a method and an apparatus for winding up coreless and soft-core rolls of film materials, in particular plastic films, whereby it is possible to wind a larger quantity of film, while at the same time maintaining or reducing the diameter of the roll, compared to conventional coreless and soft-core rolls; therefore, one of the advantages of the invention consists in the possibility of reducing the volume required by a roll to wind up a same quantity of film, which on average can be as much as 30%, thereby considerably reducing the cost for storage and transportation of the rolls.

A further object of the invention is to provide a method and an apparatus for winding up coreless and soft-core rolls, which are capable of ensuring an improved rolling up of the film to obtain rolls substantially free from irregularities.

Another object of the invention is to provide a method and an apparatus for winding up films, as mentioned previously, whereby it is possible to obtain coreless and soft-core rolls, that is to say rolls without the internal winding core tube, or rolls having a soft core tube maintaining the film in rolled up conditions substantially devoid of any stress, sufficient to compensate any shrinking caused by the elastic memory of the film, thereby preventing any risk of implosion of the rolls.

A further object of the invention is to provide a wound roll of film material suitably corrugated to comprise a large quantity of air entrapped between the wound up turns, avoiding said turns to adhere to each other.

BRIEF DESCRIPTION OF THE INVENTION

These and other objects of the invention can be achieved by means of the disclosed method, by means of the disclosed apparatus, and by the disclosed roll of embossed film material.

Other features and some preferential embodiments of the method and of the apparatus according to the invention are defined below.

According to the invention, a method for winding up either careless and softcore rolls of a film material has been provided according to which the film is continuously advanced and corrugated to be wound up into a roll, comprising the steps of:

providing a film corrugating device comprising a corrugating drum having longitudinally extending grooves;

moving the film in a non-taut condition, by controlling the feed rate of the film towards the corrugating device;

corrugating side by side arranged crosswise ribs into the film by making the film sequentially penetrate by an air jet into the grooves of the corrugating drum; and winding up the corrugated film, into a roll.

The feed rate of the film which is advanced towards the corrugating drum is continuously controlled to maintain the film in a no-stretched or non-taut condition and, to provide controlled corrugating conditions of the film into the grooves of the corrugating drum; this may be done by providing an adjustable looped path between a film feeding device and the corrugating drum, and by drawing or pulling the film on the corrugating drum with a linear speed slightly lower than the speed of the feeding device.

The looped path may be controlled by controlling the depth and or position of a floating loop freely suspended in the air by suction or by an upwardly oriented air jet, or performing the looped path downstream the feeding device by a downwardly oriented air jet, or by a movably supported idle roller, which may be controlled to balance any difference in the corrugating requirements and/or winding up of the film.

By controlling the position and/or the depth of the loop, it is therefore possible to selectively control or to change the corrugating conditions and the winding up of the corrugated film onto the roll.

According to another feature of the invention, an apparatus has been provided for winding up either soft-core and coreless rolls of film material, according to which the film is made to advance along a corrugating path between a film feeding device and a film corrugating device comprising a drum conformed to corrugate the film to be wound onto a roll, characterised by comprising:

means for performing a controlled looped path of the film between the feeding device and the corrugating device;

the corrugating drum having longitudinally extending corrugating grooves on the outer surface; and air jet generating means on a side of the corrugating drum to urge and sequentially penetrate the film material into the grooves of the corrugating drum.

BRIEF DESCRIPTION OF THE DRAWINGS

These and further features and advantages of the method and of the apparatus according to the invention, will be more clearly evident from the following description, with reference to some preferential embodiments of the accompanying drawings, in which.

DETAILED DESCRIPTION OF THE INVENTION

With reference to the figures from 1 to 4, a description is given of a first embodiment of the apparatus and of the method for winding up coreless or soft-core rolls of film material, according to the invention.

Figure 1:
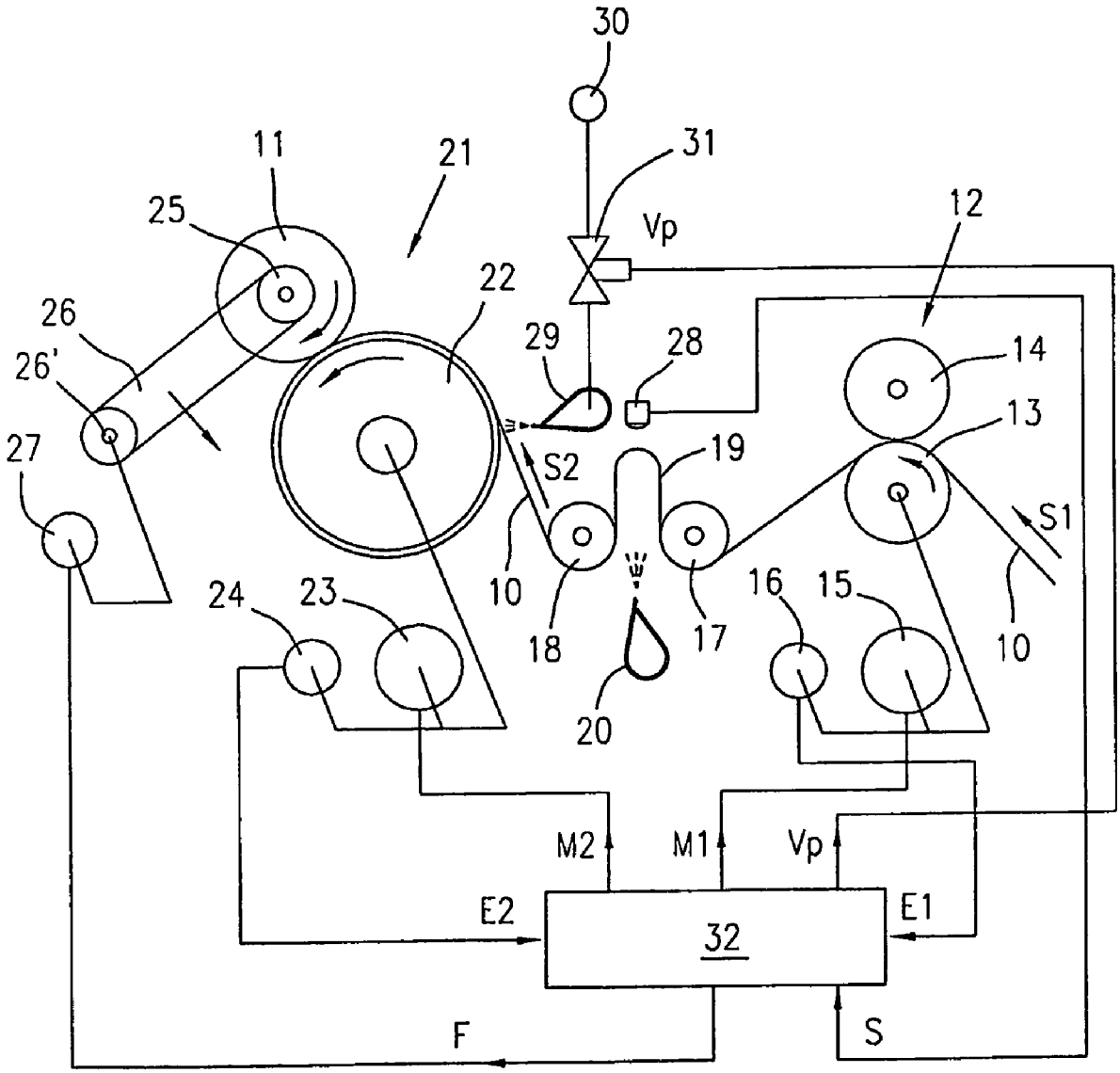
FIG. 1 shows a diagram of the apparatus, according to a first embodiment of the invention.

As shown in FIG. 1, reference number 10 indicates a film of plastic, paper or other material, which is unwound from a roll, not shown, to be corrugated and rolled up or wound onto a spindle 25, to form a coreless or softcore roll 11.

The film 10, which can be of any type, for example unrolled from largesized rolls, or directly from a production line, is made to advance along an corrugating path at a first feeding speed S1 by means of a feeding device 12 comprising a drawing roller 13 and a pressure roller 14.

The drawing roller 13 is operatively connected to a first electric motor 15 provided with a first signal generator 16, consisting for example of an incremental encoder.

Subsequently to the first drawing unit 12, the film 10 is deviated by two idle guide rollers 17 and 18, spaced apart in the longitudinal direction of the film, to provide an upwardly extending loop 19; the loop 19 is freely maintained suspended in the air, in a floating condition, for example by an air get generated by a nozzle 20, parallely extending on a side of a grooved drum 22 forming part of a corrugating device, or by several nozzles aligned in the cross direction of the film 10, or in any other way, for example by vacuum from above.

Subsequently the guide rollers 17 and 18, the film 10 is advanced towards a corrugating and film wrapping device 21 comprising a longitudinally grooved drum 22 on which the film 10 is shaped into a corrugated form, by corrugating cross ridges and grooves in absence of any tension or longitudinal stress, before being wound onto the roll 11; the roll 11 is made to rotate, by friction, by the aforesaid grooved drum 22.

The rotational speed of the drum 22 is controlled by a second electric motor 23 to draw the film 10 with a second linear speed S2 lower than and correlated to the speed S1 of the feeding device 12, for the reasons explained further on. Therefore the second electric motor 23 for controlling the grooved drum 22 is connected to a second signal generator 24 for example consisting of an incremental encoder.

The roll 11 of film material is wound onto an idle spindle 25, for example of expandable type, rotatably supported by a rocking arm 26, which can tilted around an axle 26' operated by a third electric motor 27, to constantly urge the roll 11 against the grooved drum 22 in such a way as to constantly control the diameter and the compaction degree of the roll 11 during winding.

Figure 2:
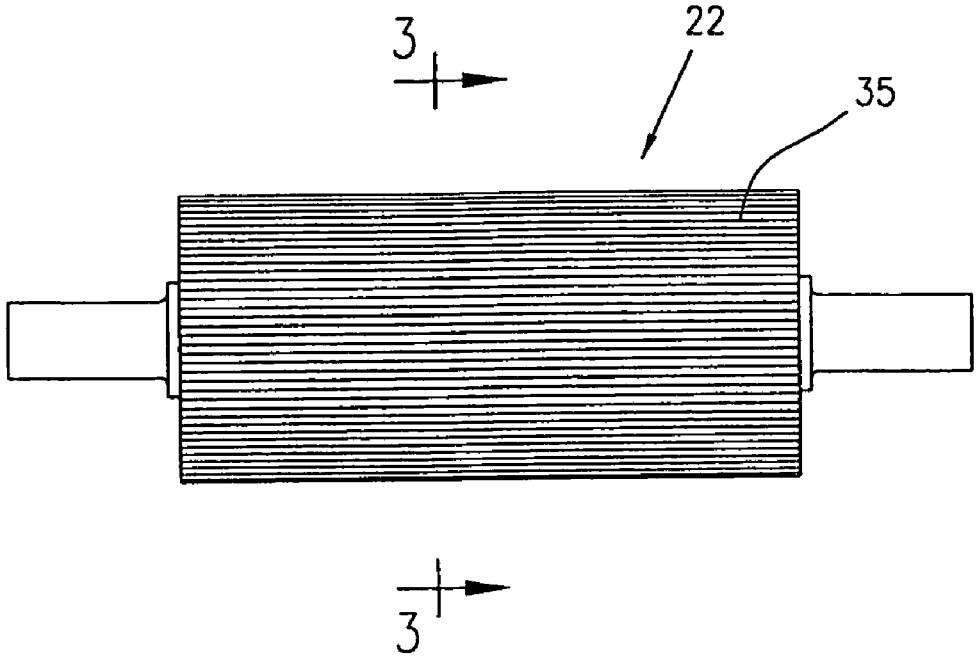
FIG. 2 shows a front view of the corrugating drum.
Figure 3:
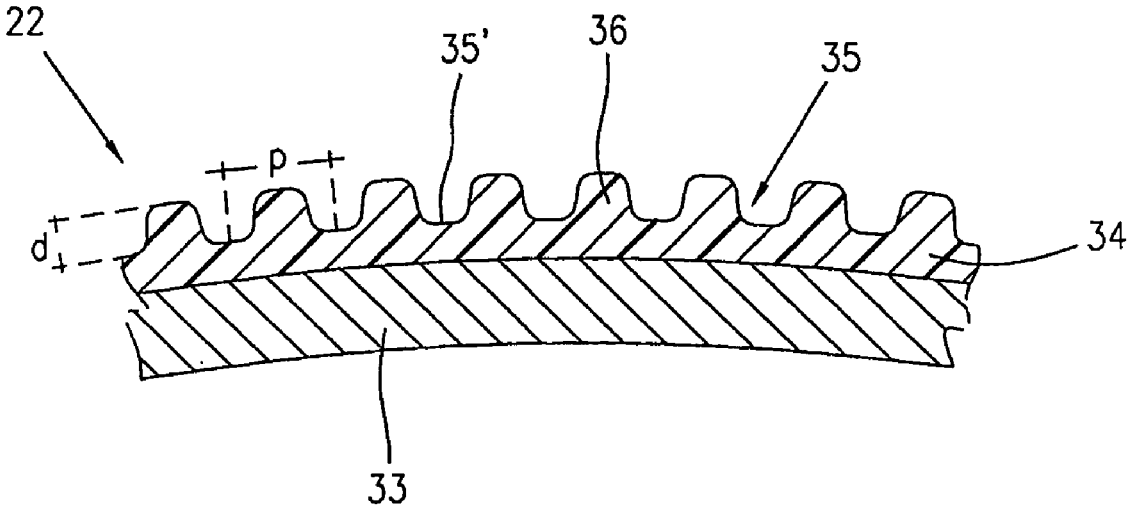
FIG. 3 shows an enlarged cutaway view of the corrugating drum, along the line 3-3 of FIG. 2.
Figure 4:
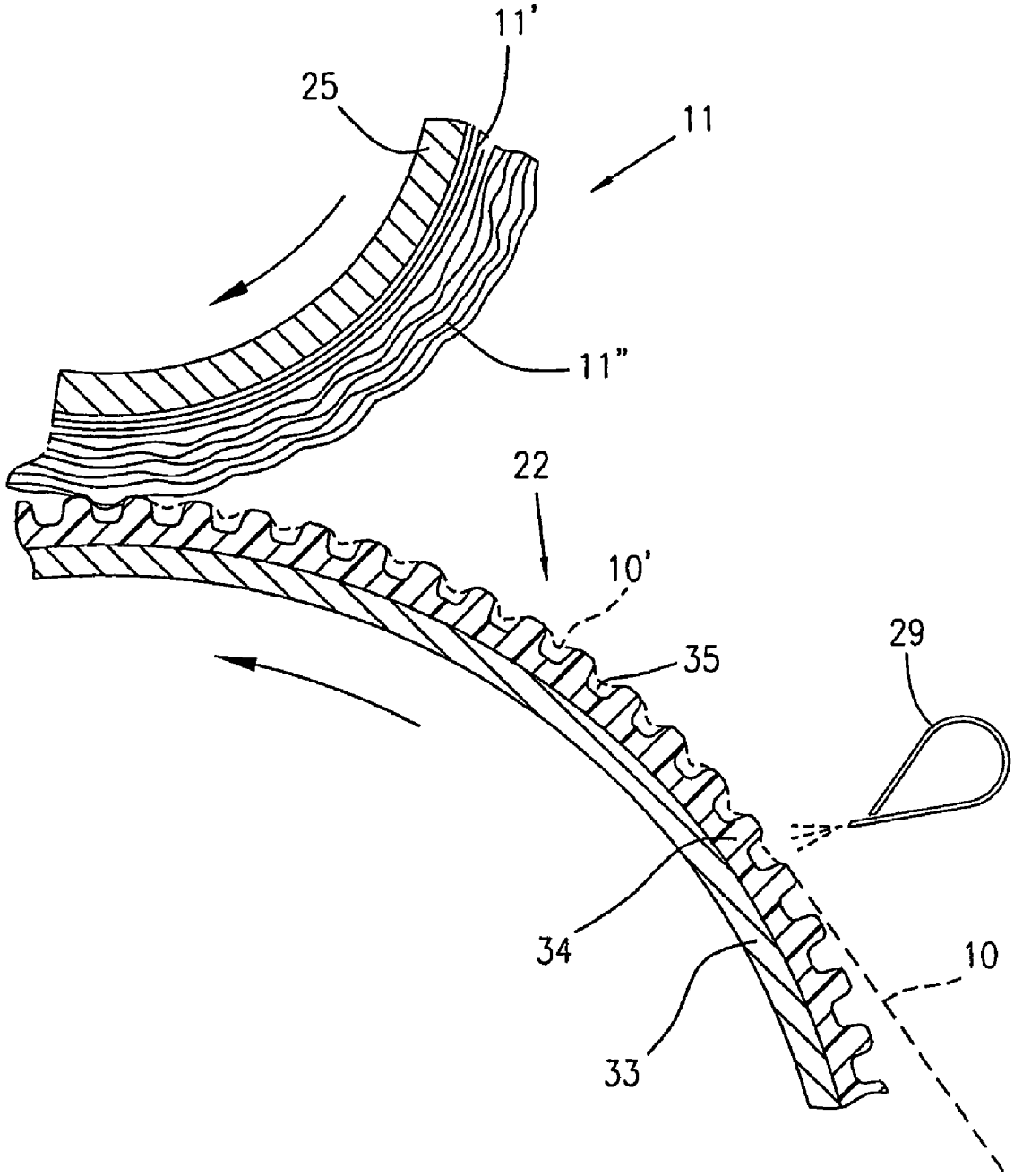
FIG. 4 shows an enlarged detail of FIG. 1.

Means are provided for controlling the feed rate of the film 10 to the embossing device 21; as shown in FIG. 1, the feed rate control means comprises a loop sensing device 28, for example an optical sensor for continuously detecting the position of and/or the depth of the loop 19, while reference number 29 indicates a nozzle or group of nozzles which extends transversally, substantially across the entire width of the film 10, parallel with and at a short space from the grooved outer surface of the drum 22; the nozzle 29 is connected to a pressure air source 30 by means of a pneumatic control valve 31, of proportional type to change and adjust the air pressure and/or the air flow rate, consequently to vary the air jet which urges the film 10 against to and into the grooves of the corrugating drum 22; the above will be explained in greater detail further on, with reference to FIGS. 2, 3 and 4 of the accompanying drawings.

Lastly, still with reference to FIG. 1, reference number 32 indicates an electronic control unit, which is programmable according to an appropriate algorithm for controlling the driving motors 15, 23, 27 and the pneumatic valve 31 for adjusting the pressure of the pressurised air, in relation to control signals received from the two encoders 16 and 24, and from the sensor 28.

In particuiar, the electronic unit 32 controls and regulates the various operative parameters of the apparatus, such as the speed S1 for advancing the film 10 by the feeding device 12, and the speed S2 at corrugating drum 22 for winding up the film 10 onto the roll 11 by means of the same corrugating device 21; the speed S2 of the film in the corrugating device must always be lower than the feeding speed S1 in the feeding device 12 so that the film 10 is made to advance and wound onto the roll 11 under nonstressed conditions; the electronic control unit 32, by means of the signals received from the sensor 28 also controls the depth or the position of the loop 19 of film, the air jet from the nozzle 29, as well as the force or pressure exerted by the roll 11 against the grooved drum 22, all as indicated in FIG. 1.

As mentioned initially, the film 10 may be wound up into a coreless or soft-core roll 11 maintaining an undulated configuration, in a condition substantially free from stress, so as to trap air along the cross folds or corrugations between adjacent turns of the roll.

A similar configuration of the film 10 while it is being wound onto the roll 11, proves to be advantageous for various reasons: firstly, by winding up the film into a corrugated form, in the absence of longitudinal stresses, makes it possible to achieve a regular formation of structurally more resistant coreless or soft-core rolls, capable of absorbing any longitudinal contraction of the film, thus reducing the risk of implosion of the same roll in that any contraction is absorbed by the cross corrugations or folds in the film.

By corrugating cross folds in the film wound into rolls, having open side ends, makes it also possible to achieve a partial discharge of the air trapped between the turns, both during the winding, and in the event of any shrinkage occurring in the film material, thereby obviating the onset of any stresses within the roll itself and a possible implosion of the inside turns; in this way it is possible to produce rolls substantially free from irregularities and defects.

This can be achieved by the use of the special grooved roller 22 and the nozzle 29 for generating a jet of pressurised air, as is illustrated in greater detail in the figures from 2 to 4, in which the same reference numbers of FIG. 1 have been used to indicate similar or equivalent parts.

As shown in FIGS. 2 and 3, the grooved drum 22 can consist, for example, of a steel cylinder 33 provided with a rubber sheathing 34 or other suitable elastically yielding material, having a plurality of grooves 35 which extend longitudinally to the drum, parallel to its rotational axis.

The profile of the grooves 35 and the ridges 36 can be of any shape; for example as shown in FIG. 3 the grooves 35, likely the ridges 36, have a rounded bottom 35' and a depth "d" ranging from 1 to 5 mm, and a pitch "p" between adjacent grooves 35 ranging from 2 to 8 mm according to the type and thickness of the film 10 to be wound up.

The winding of coreless or soft-core rolls in conformity with the method according to this invention, takes place in the following way: the film 10 is fed continuously, by means of the feeding device 12, at a first linear speed S1 corresponding to the tangential speed of the roller 13 under the control of the electronic control unit 32. Simultaneously, the film 10 is drawn by the corrugating and wrapping device 21 at a second linear speed S2 lower than the preceding speed S1, coinciding with the tangential speed of the grooved drum 22, and then wound onto the roll 11 being supported by the idle spindle 25.

The grooved drum 22 is also controlled by the electronic unit 32 in such a way as to maintain the difference between the two speeds S1-S2 at a constant pre-established value, depending on corrugating conditions and the quantity of film material in excess which has to be wound onto the roll 11 due to the number and depth of the corrugations or folds, compared to the theoretical quantity of non-corrugated film to be wound for each complete rotation of the grooved drum 22; in other words, the difference S1-S2 between the speed S1 and the speed S2, must be such as to supply an additional quantity of film material 10 to compensate for the formation of the corrugated folds or corrugations, at each rotation of the grooved drum 22.

The above is made possible by the fact that the electronic unit 32 controls, by an electronic gearing connection, the motors 15 and 23 which actuate the feeding device 12 and the corrugating device 21.

Between the two devices 12 and 21, the film 10 is made to advance in a non-tout condition substantially free from stress; in this connection, as shown in FIG. 1, in a position between the feeding and corrugating devices, in correspondence with the two guide rollers 17 and 18, the film 10 is deviated to form an U-shaped loop 19 which is freely suspended in the air, in a floating condition, for example by means of a weak air jet directed upwards, generated by the nozzle 20, or in any other suitable way, for example by vacuum from above; the position or depth of the loop 19 of film is continuously detected by a sensor 28, to compensate for any variations in the feeding speed S1 and corrugating or winding speed S2 of the film 10.

Subsequently to the guide rollers 17, 18 and the loop 19, the film 10 is made to advance drawn by the grooved drum 22, in correspondence with which a second nozzle 29 is arranged. The nozzle 29 generates an air blade along the entire length of the grooved drum; by controlling the feed rate of the film 10 and the pressure of the air jet by means of a proportional valve 31, it is thus possible to make the film 10 penetrate into the individual grooves 35 of the drum 22 by a desired quantity under controlled conditions, thereby creating a succession of cross folds or corrugations 10' extending over the entire width of the film 10.

Figure 5:
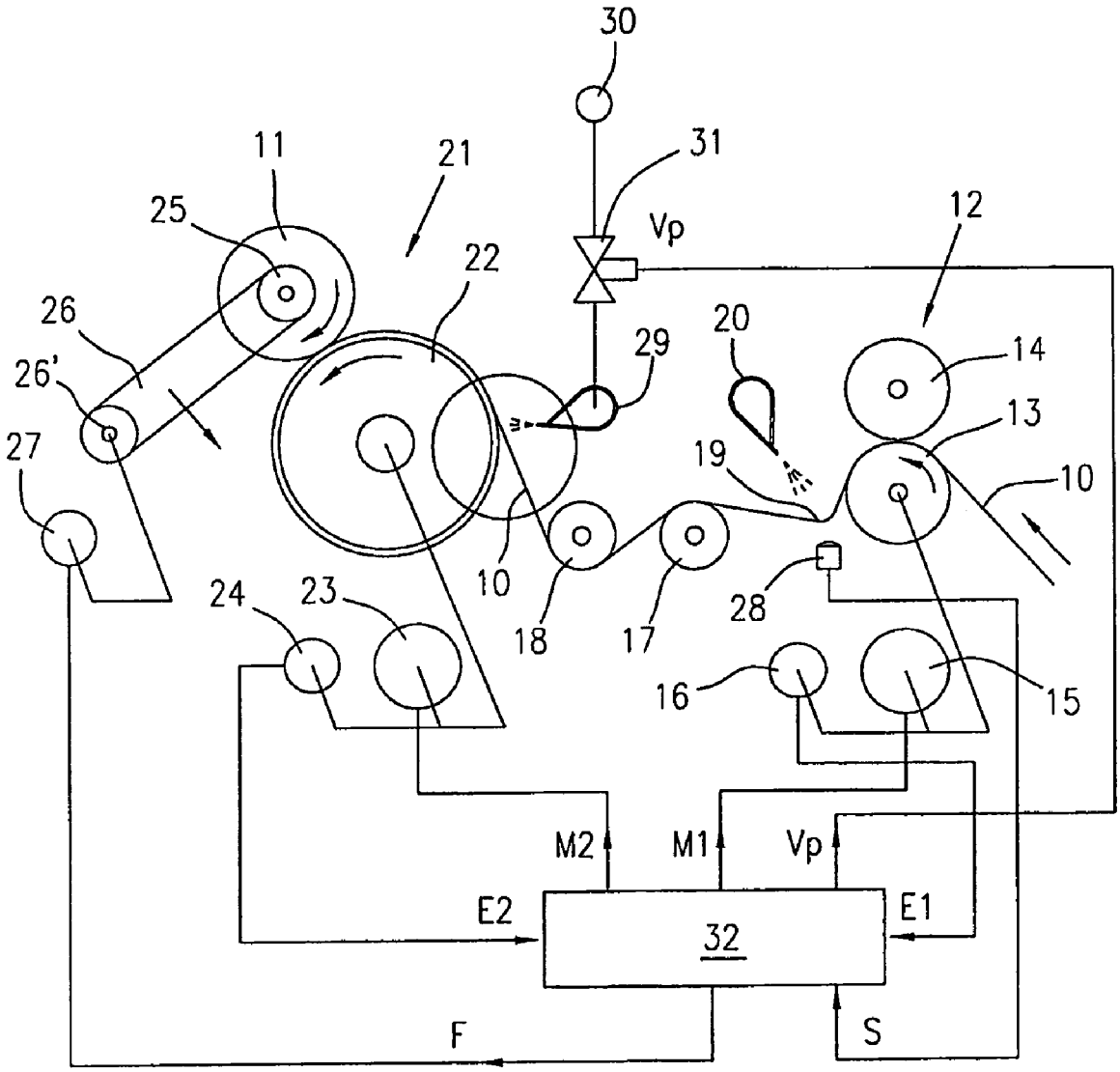
FIG. 5 shows the diagram of a second embodiment of the apparatus according to the invention.

The film 10, in a corrugated condition, drawn or pulled by the drum 22 is then wound up, without any tension, onto the roll 11 maintained in rotation by the grooved drum itself, as shown in the enlarged detail of FIG. 5.

The method for winding up and forming rolls 11 of corrugated film materials, takes place under the control of the electronic unit 32 conformed for such purpose. In fact, the electronic unit 32, with its outlets M1 and M2 controls the motors 16 and 23 of the feeding and corrugating devices 12 and 21, and consequently the feeding speed S1 and the winding speed S2 of the film 10. With its outlet Vp it controls the solenoid valve 31, and consequently the air jet and the depth of penetration of the film 10 into the grooves 35 in the grooved drum 22 which determines the depth of the corrugations and the quantity of film wound in excess onto the roll 11 at each turn; as mentioned initially, this helps to make the structure of the roll 11 more stable, in the production either of coreless and softcore rolls.

Moreover, the electronic unit 32 with its outlet F controls, in a programmed mode, the motor 27 for actuating the support arm 26 for the roll 11, and consequently the pressure exerted by the same roll 11 against the grooved drum 22, thereby making it possible to control the diameter and the compactness of the roll 11, during winding of the film 10, in relation to data programmed into the control unit 32.

Lastly, at its inlets E1, E2 and S the control unit 32 receives control signals from the encoders 16, 24 and from the sensor 28; therefore, in the event the sensor 28 is detecting a displacement of the loop 19 of the film, due for example to a variation in the winding speed S2, or for any other cause, the control unit 32 actuates the motors 15 and/or 23 to restore the balance in the system, in relation to operative parameters preset into the control unit 32.

In order to produce coreless or soft-core rolls which are structurally more stable, as well as free from defects, according to a further feature of the invention it has been found advantageous to wound a number of initial turns of the roll in a compact mode; this may be done at the beginning of the winding step, for example by pressing the roll 11 against the grooved drum 22, by means of the arm 26, maintaining under tension the film during the winding, and then slightly releasing the pressure, continuing the winding of the film in the corrugated form as described previously; this makes it possible to form an initial support core by the more compacted turns on which to wind the subsequent turns of the roll, thereby reducing or eliminating any risk of implosion.

The above has been shown by way of example in FIG. 4 where reference 11' indicates the first group of compacted turns wound without corrugations, while reference 11" indicates the subsequent corrugated turns, during the winding up step of the roll.

In this connection, the control unit 32 is programmed in such a way that at the beginning of the winding of each roll, the support arm 26 is moved in the direction of the arrow indicated in FIG. 5, pressing the roll 11 more against the grooved drum 22, during the winding up of the first 20-50 turns of film, thereupon continuing the winding of the corrugated film while constantly maintaining the latter in a non-taut condition.

At the completion of a roll, the latter is withdrawn after having disengaged it from the spindle, for example, by reducing the diameter of the expandable spindle 25, or in any other suitable way.

FIG. 5 of the drawings shows a second embodiment of the apparatus, which differs from the previous one in respect to the system for forming the loop 19, and for maintaining the film 10 in an unstressed condition; therefore in FIG. 5 the same reference numbers have been used to indicate parts similar or equivalent to those of FIG. 1.

The embodiment of FIG. 5 differs from that of FIG. 1 in that the loop 19 is now directed with the bottom facing downwards, and is formed immediately downstream of the feeding device 12, between the latter and the first guide roller 17; moreover, the same nozzle 20 also is now facing downwards, while the sensor 28 has been positioned beneath the loop 19.

The apparatus of FIG. 5 operates exactly in the same way as the apparatus of FIG. 1.

Figure 6:
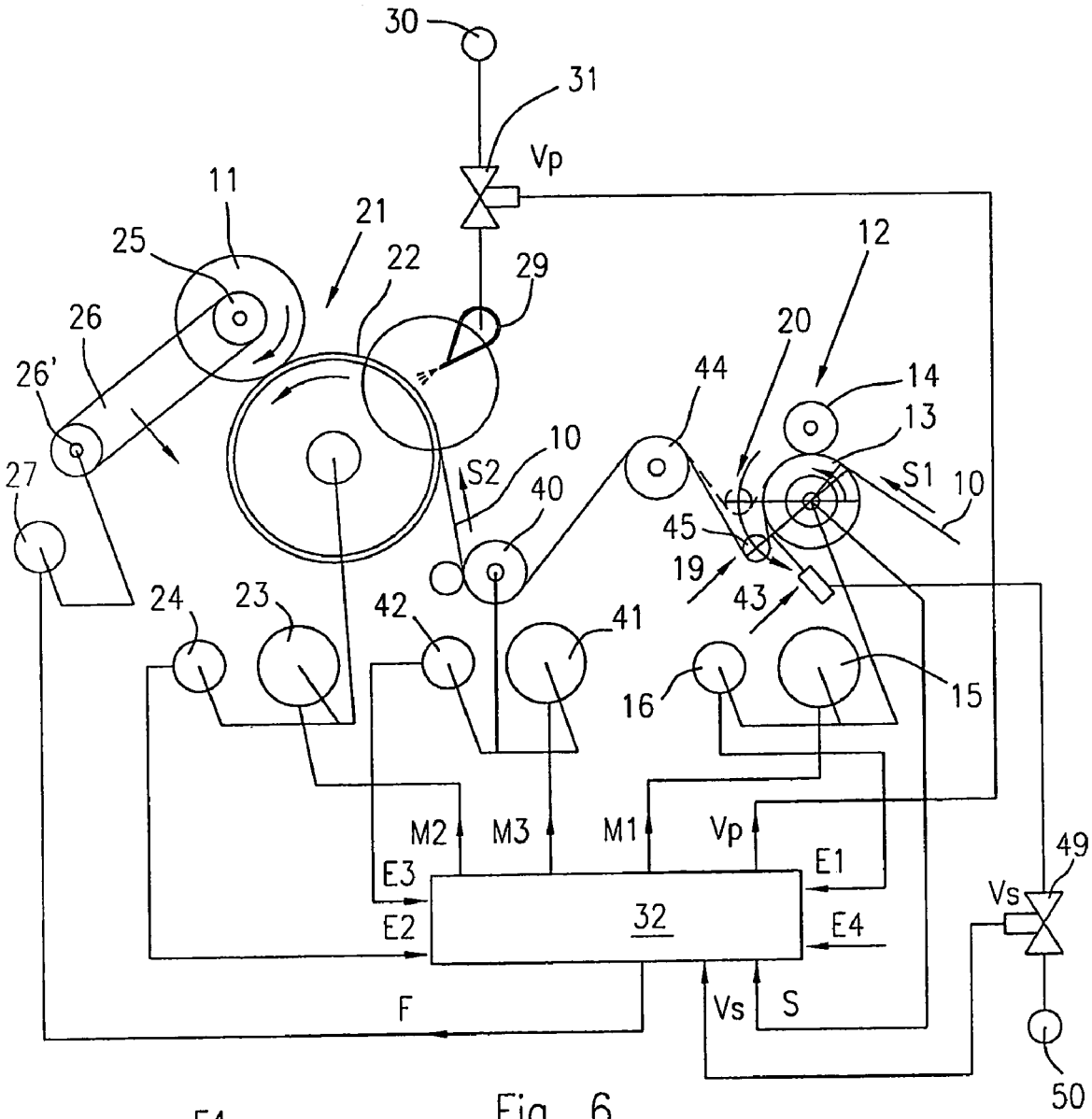
FIG. 6 shows the diagram of a third embodiment.
Figure 7:
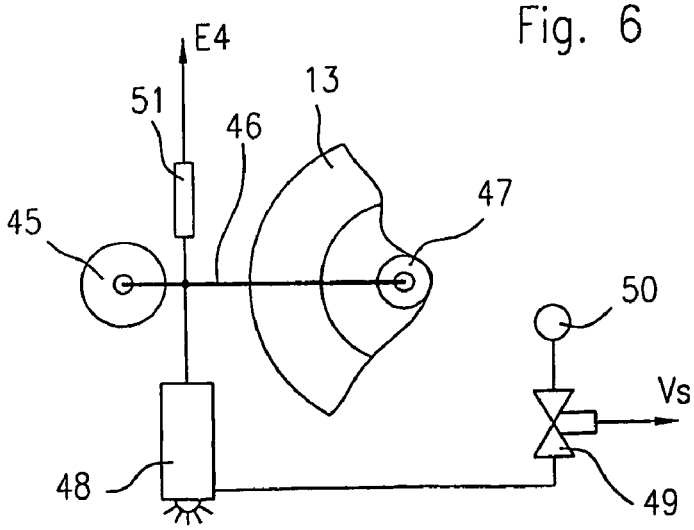
FIG. 7 shows a detail of FIG. 6.

A third embodiment is shown in FIGS. 6 and 7 of the drawings, in which the same reference numbers of the previous figures have been used for corresponding parts.

The embodiment of FIGS. 6 and 7 differs from the embodiments of FIGS. 1 and 5 in that the loop 19, downstream the feeding device, is provided by a pneumatically actuate devices 43 comprising a movable and adjustably supports idle roller 45.

As shown, the idle roller 45 is supported by an arm 46, which may pivot around an axis 47 coaxial to the shaft of the roll 13.

The pivotal movement of the arm 46 is adjustably performed by an actuator, for example by an air pressure actuated cylinder 48 hinged to the arm 46 and connected to an air pressure source 50 by a control valve 49 controlled by the outlet Vs of the control unit 33.

Position sensing means for the idle roller 45, such as linen encoder 51 are provided to control the position and/or the depth of the loop 16 as per previous cases.

An additional feature of the method and apparatus according to the invention is again shown in FIG. 6; as shown in this figure, an intermediate filmdrawing device, comprising a drawing or pulling roll 40, has been added upstream and close to the corrugating drum 22, to better control the feed rate of the film 10.

The drawing roll 40 is connected to a motor 41 connected to a signal generator 42, both connected to the outlet M3 and inlet E3 of the control unit 32.

The apparatus of FIG. 6 again operates as the apparatus of the previous embodiments, with the additional feature of more precisely control the feed rate of the film to the corrugating roll and the final diameter of the same roll 11 by adjusting and controlling the corrugating depth of the film in the grooves of the corrugating drum 22.

From what has been described and shown in the accompanying drawings, it is evident that a method and an apparatus for producing coreless and soft-core rolls, of film materials have been provided, by means of which the aforementioned scopes and advantages are achieved; therefore other modifications or variations may be made to the method for producing the rolls, and to the apparatus itself, in relation to specific requirements, without thereby departing from the scope of the claims.

The invention claimed is:

1. A method for winding up coreless and soft-core rolls, according to which a film material is continuously advanced between first and second spaced apart drawing units, to be corrugated and wound up into a roll comprising the steps of:

providing the second drawing unit with a corrugating drum having longitudinally extending grooves;

making the film advance between the two drawing units maintaining the film in a non-taut condition;

continuously corrugating side by side arranged crosswise ribs on the film by making the film continuously penetrate into the grooves of the corrugating drum by an air jet; and winding up the corrugated film, into a roll.

2. The method according to claim 1, further comprising maintaining the film in the non-taut condition, between the first and the second drawing units, making the film perform a floating looped path.

3. The method according to claim 2, further comprising advancing the film at a first feeding speed upstream the floating looped path, and by winding up the corrugated film onto the roll at a second winding speed different from the feeding speed.

4. The method according to claim 3, wherein the second winding speed is lower than the first feeding speed.

5. The method according to claim 3, further comprising detecting the floating looped path of film by sensing means and controlling the feeding speed and winding up speed of the film in relation to the detected position of the floating looped path.

6. The method according to claim 3, further comprising maintaining, at a constant value, the difference between the feeding speed and the winding speed of the film, by controlling at least one of said feeding and said winding speed in relation to a displacement of the floating looped path detected by sensing means.

7. The method according to claim 2, further comprising performing said floating looped path in an intermediate position between the first and the second drawing units.

8. The method as claimed in claim 7, further comprising forming said floating looped path by maintaining the film freely suspended in the air.

9. The method according to claim 8, further comprising maintaining the floating looped path, by vacuum.

10. The method according to claim 2, further comprising performing said floating loop path immediately downstream the first drawing unit, by means of a downwardly directed air jet.

11. The method according to claim 1, further comprising winding up the film onto the roll, causing a pressure on the same roll.

12. The method according to claim 11, further comprising more tightly winding a number of turns of the roll, during the initial winding up step.

13. The method according to claim 11 in which the roll of film is drawn into rotation directly by the corrugating drum by controlling the pressure of the roll against the corrugating drum.

14. The method according to claim 1, further comprising controlling the quantity of film wound onto the roll, by controlling the penetration of the film into the slots of the corrugating drum, by said air jet.

15. The method according to claim 1, further comprising varying the quantity of film wound up onto the roll, by varying the penetration of film into the slots of the corrugating drum by said air jet.

16. The method according to claim 1, further comprising winding a number of turns of film material around the roll prior to corrugating the film.

17. A roll of corrugated film material according to the method of claim 1, wherein the roll comprises overlapped film material having transversely corrugated folds.

18. A roll of corrugated film material, according to claim 17, wherein some of the film wound around the roll is uncorrugated.

19. An apparatus for winding up coreless and soft-core rolls of film materials, according to which a film is made to advance along a drawing path, comprising a drawing drum conformed to corrugate the plastic film as it is being wound onto a roll, said apparatus comprising:

first and second drawing units for the film, spaced apart along said drawing path, each drawing unit being provided with a respective electric control motor;

a signal generator connected to each control motor;

the second drawing unit comprising a corrugating drum having a plurality of longitudinally extending slots;

means for generating an air jet to urge the film against the corrugating drum to at least partially penetrate the same film into the slots of the corrugating drum;

means for forming a floating loop of film between said first and second drawing units, and sensing means for detecting the floating loop;

the apparatus also comprising an electronic control unit, said control unit being conformed and programmable to control the feeding of the film by the first drawing unit at a first speed, and the drawing of the film by the second drawing unit at a second speed lower than the first speed, in relation to control signals received from said signal generators and from said sensing means for controlling the floating loop.

20. The apparatus according to claim 19, wherein said means for forming the floating loop of film are provided in an intermediate position between the two drawing units.

21. The apparatus according to claim 19, wherein said means for forming the floating loop of film are provided in a position immediately downstream of the first drawing unit.

22. The apparatus according to claim 19, wherein said means for forming the floating loop of film comprise a nozzle for an air jet.

23. The apparatus according to claim 22, wherein said nozzle for the air flow is connected to a pressurised air source by an air-flow regulating valve operatively connected to the control unit.

24. The apparatus according to claim 19, wherein said means for forming the floating loop of film comprise a vacuum device.

25. The apparatus according to claim 19, wherein said control unit comprises first and second outlets operatively connected to the electric control motors, and first and second inlets connected to said signal generators, said control unit being programmable to maintain the difference of the feeding and winding speeds of the film at a constant value, between said first and second drawing units in relation to control signals provided by said sensing means for detecting the position of the floating loop.

26. The apparatus according to claim 25, further comprising support means for the roll movably arranged and operatively connected to the control unit, the control unit being programmed to move the support means to urge the roll against the corrugating drum in a controlled way.

27. The apparatus according to claim 26, wherein said control unit is programmed to control said apparatus to wind the film around the roll tighter at the beginning of the winding up of the roll than at other portions of the winding up of the roll.

* * * * *